US012031784B1

(12) United States Patent
DeMonico

(10) Patent No.: US 12,031,784 B1
(45) Date of Patent: Jul. 9, 2024

(54) ADAPTED FORCED RESET TRIGGER

(71) Applicant: ABC IP, LLC, Dover, DE (US)

(72) Inventor: Lawrence DeMonico, Austin, TX (US)

(73) Assignee: ABC IP, LLC, Dover, DE (US)

( * ) Notice: Subject to any disclaimer, the term of this patent is extended or adjusted under 35 U.S.C. 154(b) by 0 days.

(21) Appl. No.: 18/052,606

(22) Filed: Nov. 4, 2022

Related U.S. Application Data

(60) Provisional application No. 63/276,090, filed on Nov. 5, 2021.

(51) Int. Cl.
*F41A 17/46* (2006.01)
*F41A 19/10* (2006.01)
*F41A 19/43* (2006.01)

(52) U.S. Cl.
CPC ..... *F41A 17/46* (2013.01); *F41A 19/10* (2013.01); *F41A 19/43* (2013.01)

(58) Field of Classification Search
CPC ..... F41A 17/46; F41A 19/10; F41A 19/43
See application file for complete search history.

(56) References Cited

U.S. PATENT DOCUMENTS 3,318,192 A 5/1967 Miller et al.
4,023,465 A * 5/1977 Inskip ..... F41A 19/03 89/142
4,133,128 A * 1/1979 Brush ..... F41A 17/00 89/143
5,068,990 A * 12/1991 Marzocco ..... F41A 17/56 42/70.04
5,485,776 A * 1/1996 Ealovega ..... F41A 19/03 89/135
6,976,416 B2 12/2005 Ealovega
7,398,723 B1 * 7/2008 Blakley ..... F41A 19/10 89/129.01
7,690,144 B2 * 4/2010 Fagundes de Campos ..... F41A 17/72 42/70.08
9,151,557 B2 * 10/2015 Daley, Jr. ..... F41A 19/46
10,254,067 B2 4/2019 Foster
10,436,535 B1 10/2019 Bradshaw et al.
10,514,223 B1 12/2019 Rounds
10,767,950 B2 * 9/2020 Lake ..... F41A 17/56
11,578,940 B2 * 2/2023 Lake ..... F41A 19/10

* cited by examiner

*Primary Examiner* — Michelle Clement
(74) *Attorney, Agent, or Firm* — Wood Herron & Evans LLP

(57) ABSTRACT

In a forced rest trigger mechanism, provided is an extended trigger member locking device having a locking member that is movable between a first position in which it locks a trigger member against pulling movement and a second position where it does not restrict movement of the trigger member. The locking member is configured to be movably supported by a frame and includes a generally upward extension portion configured to make actuating contact with a surface of a bolt carrier. The locking member has a body portion that is movably supported and an upward extension portion that is separately movable relative to the body portion between an extended position and a deflected position.

6 Claims, 5 Drawing Sheets

ADAPTED FORCED RESET TRIGGER

TECHNICAL FIELD

This invention relates to a semiautomatic firearm trigger adapted for use in certain weapons platforms or calibers. In particular, it relates to a forced rest trigger assembly having a trigger locking member with a one-way folding capability to be actuated by forward movement of a bolt carrier assembly while allowing the bolt carrier to pass while cycling to the rear.

BACKGROUND

A forced reset semiautomatic trigger is described and shown in U.S. Pat. No. 10,514,223, issued Dec. 24, 2019, the contents of which are hereby incorporated herein in its entirety by this reference. Its structure and function are fully described therein. The embodiment illustrated in that patent is particularly adapted for use in an AR15-pattern firearm.

The AR10 firearm pattern is similar in design, concept, and function to the AR15, but fires the larger 7.62 mm NATO (.308 Winchester) caliber cartridge and some dimensional specifications are somewhat less standardized. The larger caliber requires certain parts to be scaled differently from the AR15 pattern, resulting, for example, in a different profile of the bolt carrier body and spacing relative to the lower receiver and trigger mechanism. In particular, the rear or tail portion of the AR10-pattern bolt carrier is positioned vertically further from the lower receiver and trigger assembly parts, while a forward portion of the AR10-pattern bolt carrier is situated lower.

The embodiment illustrated in U.S. Pat. No. 10,514,223 could be installed in an AR10-pattern lower receiver (because the assembly/pivot pin locations are substantially the same), but it would not be operable because the upward extension of the locking member (bar) would be too short to be contacted and actuated (to release the trigger member) by the rear/tail portion of the bolt carrier as it reaches the in-battery position. However, if the upward length/height of the locking member is extended sufficiently to be actuated, it would then interfere with a lower surface of a forward portion of the bolt carrier as it cycles rearward, again making the device inoperable.

SUMMARY OF THE INVENTION

The present invention provides a deflectable extension of the locking member that is actuated by forward movement of the bolt carrier, but deflects or folds to avoid interfering contact with the forward portion of the bolt carrier as the bolt carrier cycles to the rear.

In a forced rest trigger mechanism a trigger member locking device has a locking member that is movable between a first position in which it locks a trigger member against pulling movement and a second position where it does not restrict movement of the trigger member. The locking member is configured to be movably supported by a frame and includes a generally upward extension portion configured to make actuating contact with a surface of a bolt carrier. According to an aspect of the invention, the locking member has a body portion that is movably supported and an upward extension portion that is separately movable relative to the body portion between an extended position and a deflected position.

Two example embodiments are illustrated having a one-way hinge feature that causes the locking member to pivot in one direction when actuated by a rear portion of the bolt carrier as it returns to the in-battery position, and to give way (i.e., deflect or fold) without pivoting the remainder of the locking member when contacted by the forward portion of the bolt carrier as it cycles to the rear.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
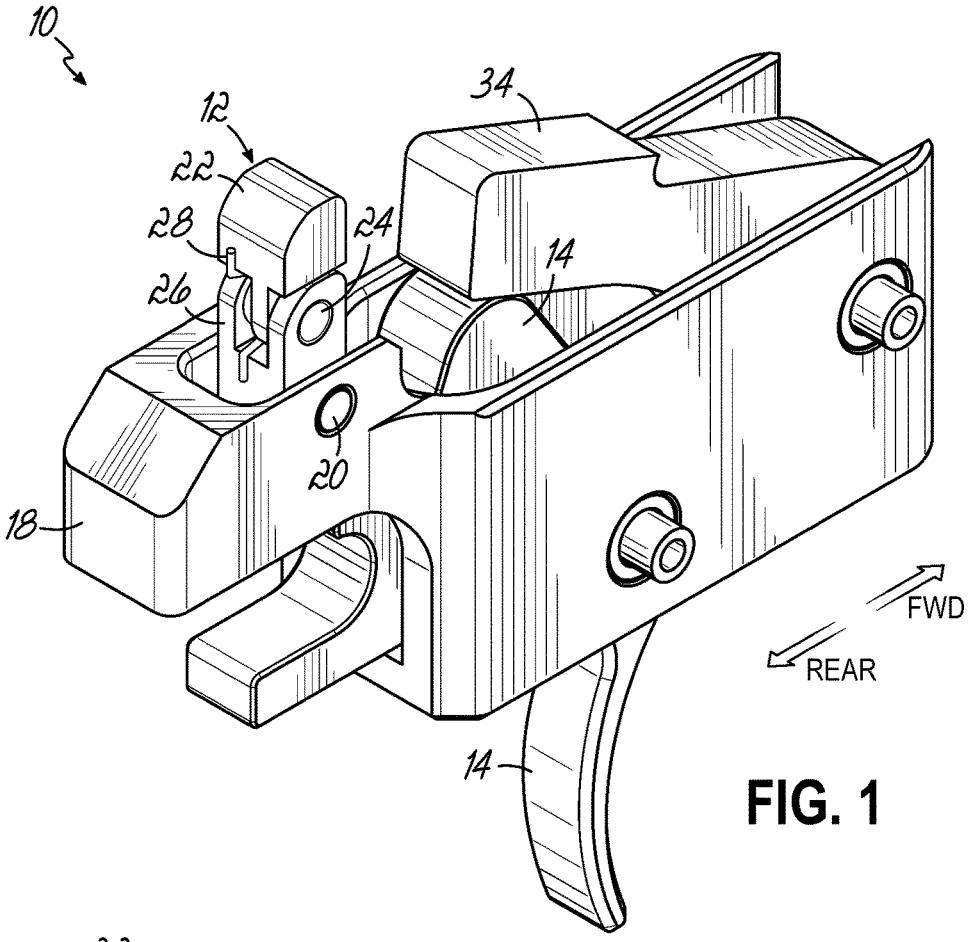
FIG. 1 is an isometric view of a trigger mechanism incorporating one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIG. 1, therein is shown a forced reset semiautomatic trigger assembly 10 with a locking member 12 according to a first embodiment of the present invention. As described in the aforementioned U.S. Pat. No. 10,514,223, the locking member (bar) 12 locks the trigger member 14 and prevents it from being pulled any time the bolt carrier assembly 16 is not in the substantially in-battery position. The bolt, firing pin, and other parts of the bolt carrier, the operation of which are well known to a person of ordinary skill in the art, are omitted from the illustrations for clarity. The trigger assembly can also include a trigger spring 15 that determines the pull force needed to pull the trigger member 14, but the force of the spring 15 may be insignificant in returning the trigger member 14 to the reset position relative to the force of the hammer 34. As used herein, "bolt," "bolt carrier," "bolt carrier body," and/or "bolt carrier assembly" may be used interchangeably to refer to the part of the firearm action that reciprocates as the action cycles. The locking member 12 of the present invention includes a deflectable portion that moves to allow passage of the forward portion of the bolt carrier 16 as it cycles to the rear, which can include a hinging structure, as will be described in greater detail below.

The locking member 12 is supported to move (in this case, pivot, on a transverse axis) by the trigger housing 18. It may be carried, for example on a substantially transverse pivot pin 20, which allows the locking member 12, to pivot as a whole unit. Likewise, the locking member could be supported by a frame other than a trigger housing, such as a separate frame or the receiver of the firearm (not shown).

Figure 2:
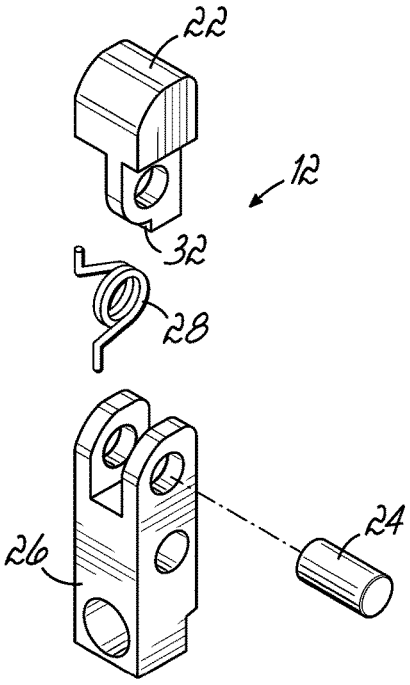
FIG. 2 is an exploded isometric view of the locking member according to this embodiment of the invention.
Figure 3:
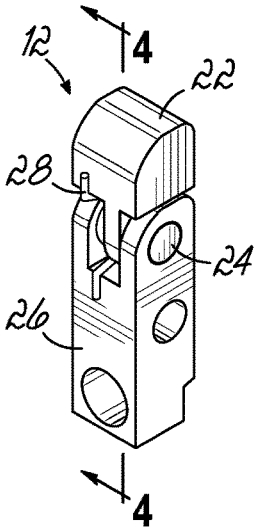
FIG. 3 is an assembled isometric view thereof.
Figure 4:
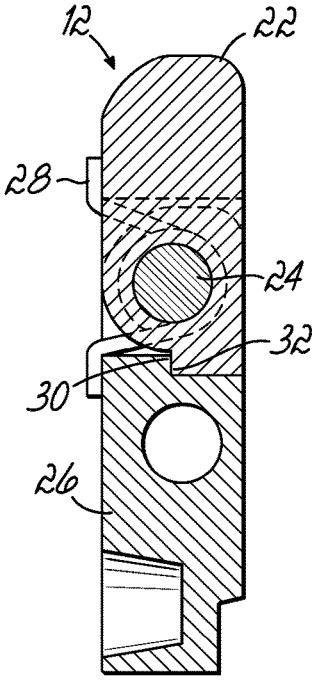
FIG. 4 is a cross-sectional view taken substantially along line 4-4 of FIG. 3.

Referring now also to FIGS. 2-4, the locking member 12 acts as a pivot lever with lever arms extending substantially upwardly and downwardly from a substantially central pivot axis. The upper lever arm portion includes a foldable extension portion 22 that pivots on, for example a transverse pivot pin 24 relative to the locking bar body 26. A spring means is provided to maintain the foldable extension 22 in the extended position. The spring means may be a torsion spring 28, as illustrated, or may be some other type of spring, such as a leaf spring, etc. the extension portion 22 could be made from a resilient material configured to deflectably bend in one direction while retaining rigidity in an opposite direction.

As best indicated in FIG. 4, the locking member body 26 and foldable extension 22 may include corresponding abutment surfaces 30, 32 configured to limit the movement of the foldable extension 22 in one direction. Thus, force applied from a rearward direction toward the front to the foldable extension 22 causes the entire locking member 12 to pivot on the pivot pin 20 relative to the housing 18. Rearward force applied to the foldable extension 22 from the front toward the rear causes the foldable extension 22 to fold on the pivot pin 24 and allow the bolt carrier 16 to pass without causing pivotal movement of the locking member body 26.

Figure 5:
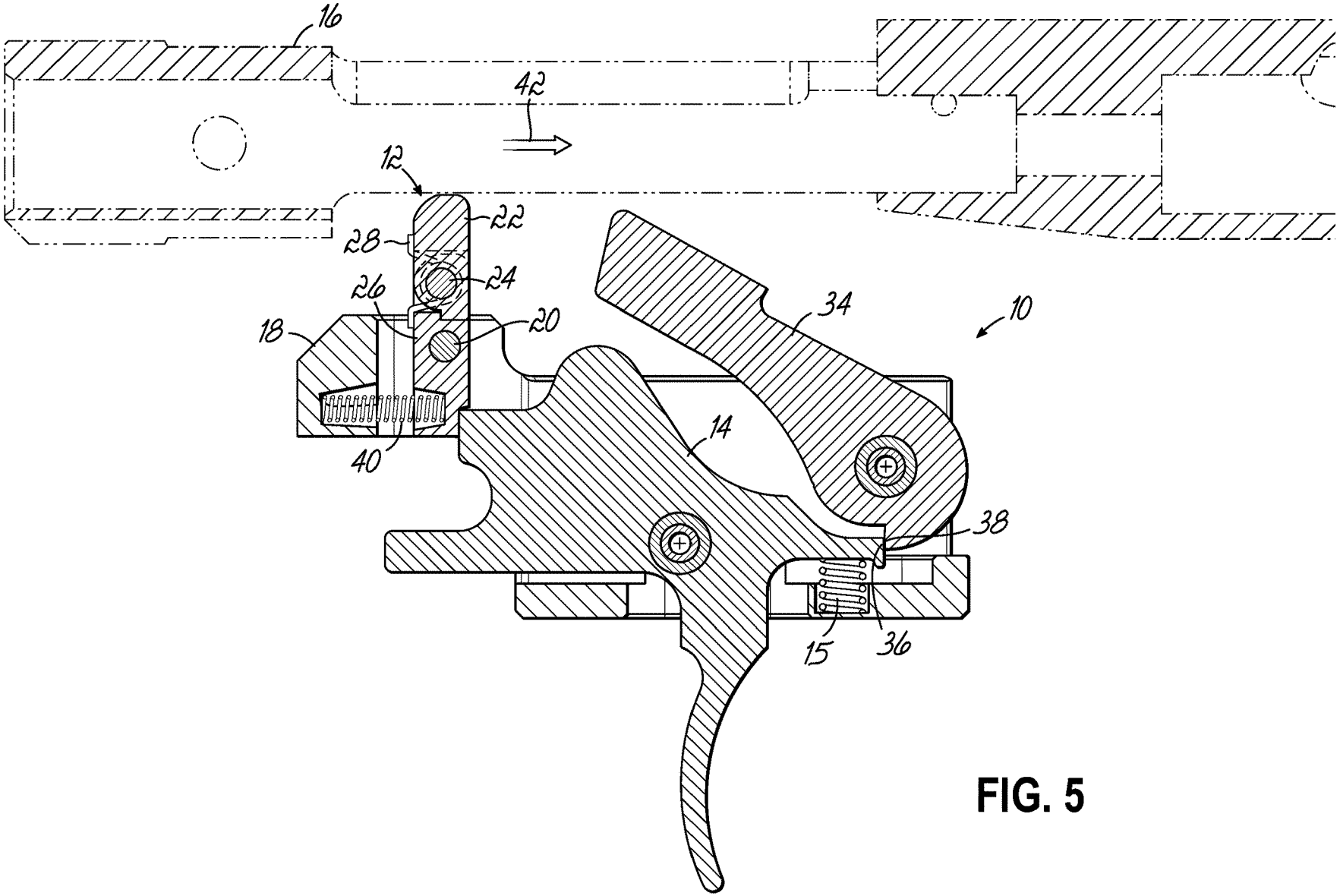
FIG. 5 is a side sectional view of a trigger mechanism with a locking member according to this embodiment of the invention and a bolt carrier, in phantom lines, showing the bolt carrier moving forward toward the in-battery position

Referring now to FIG. 5, therein is shown in a sectional side view the relative positions of the trigger assembly 10 and bolt carrier body 16. As shown in FIG. 5, the hammer 34 has been reset by prior rearward reciprocating movement of the bolt carrier 16. The pivotal reset of the hammer 34 has forced the trigger member 14 to its reset position, at which the sear 36 engages and holds the sear notch 38 of the hammer 34. Likewise in this position, the locking member 12 is biased to the locked position by a spring 40 and prevents the trigger member 14 from being pulled by the user. This function is described in the aforementioned U.S. Pat. No. 10,514,223. As depicted by arrow 42 in FIG. 5, the bolt carrier 16 is reciprocating forwardly toward the in-battery position.

Figure 6:
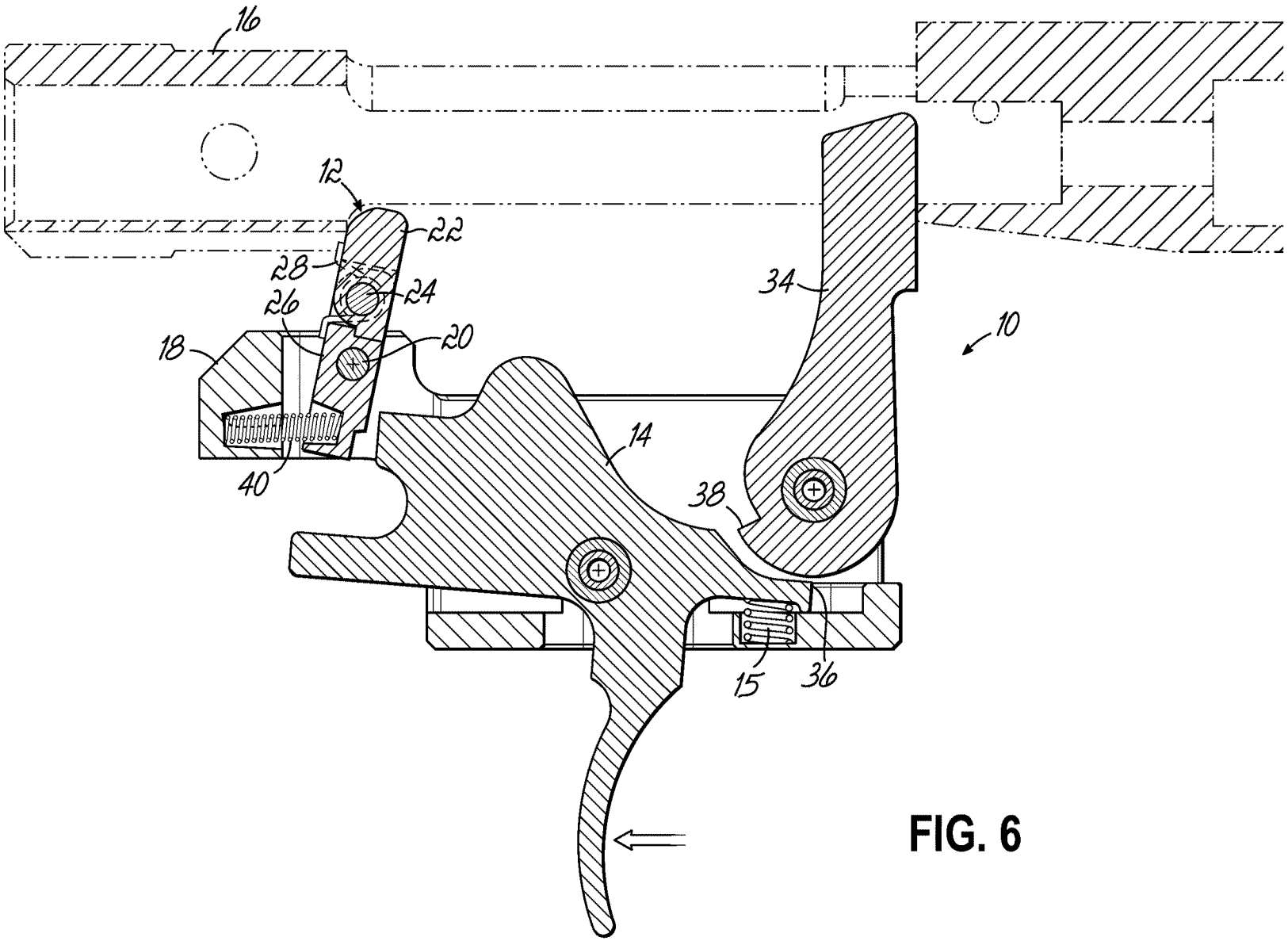
FIG. 6 is a similar view showing the bolt carrier in an in-battery position with the blocking member displaced (actuated) by the bolt carrier, the trigger member pulled, and the hammer released.

Referring now to FIG. 6, therein the bolt carrier 16 has returned to the substantially in-battery position, contacting the deflectable extension portion 22 of the locking member 12 from the rear and causing the locking bar 12 to deflect (e.g., pivot) as a whole about transverse pivot pin 20 against the bias of the spring 40. As understood by a person of ordinary skill in the art, the bolt carrier 16 first contacts the locking member 12 before it reaches the fully in-battery position and then continues to travel forward the remaining distance as it moved the locking member 12 from one position to another. In this position, the locking member 12 has released the trigger member 14, allowing the user to pull the trigger member 14 (see arrow 44), releasing the hammer 34, and allowing it to be spring biased into contact with the firing pin (not shown).

Figure 7:
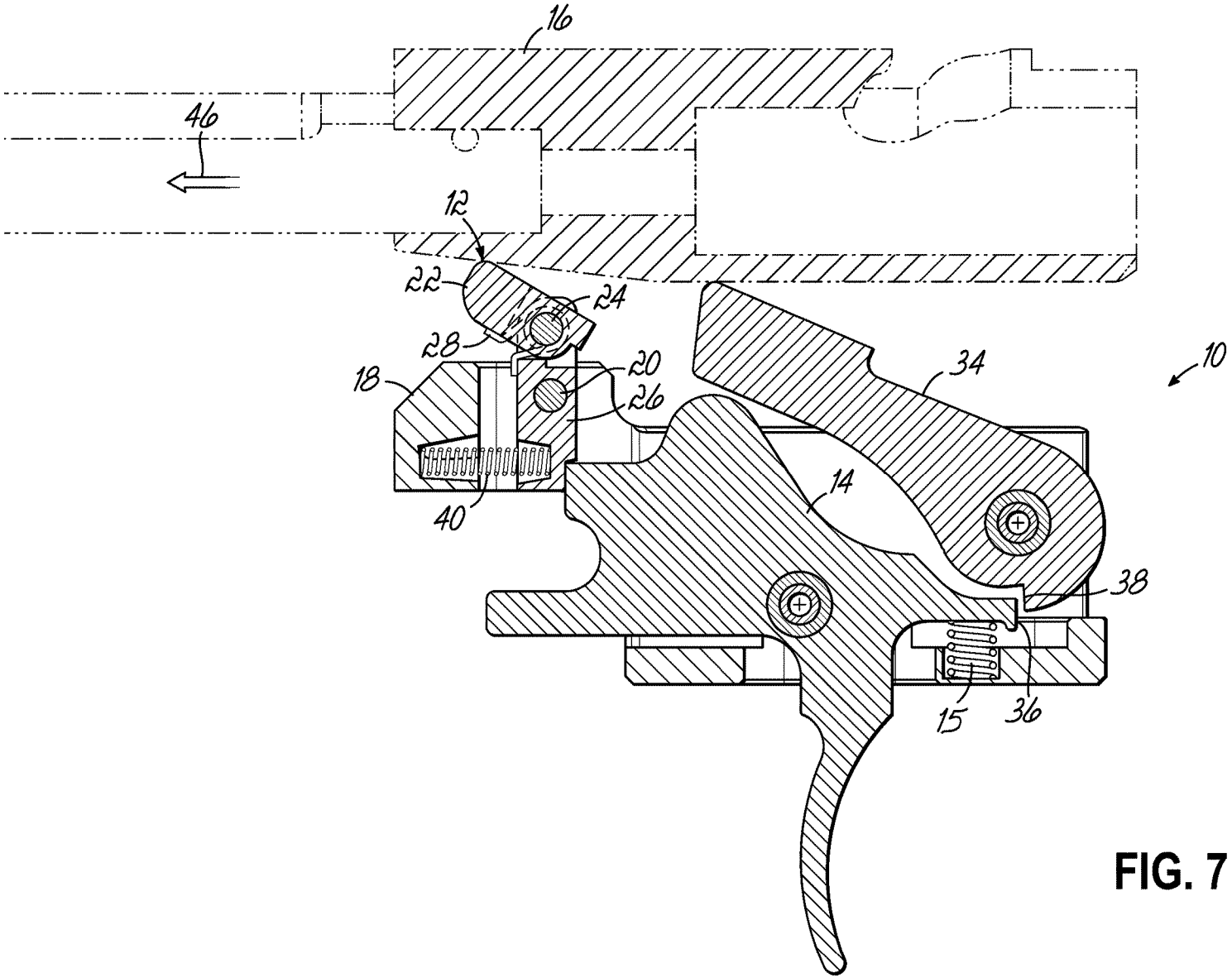
FIG. 7 is a similar view showing the bolt carrier moving toward its rearward cycled position in which it has pivoted the hammer against the trigger member to force the trigger member to the reset position and the upper extension of the locking member is pivoted to allow passage of the bolt carrier without interference or affecting the locking status of the locking member.

Referring now to FIG. 7, therein is shown the trigger assembly 10 with the hammer 34 and trigger member 14 forced to the reset position in which the sear 36 is engaged with the sear notch 38. As the bolt carrier 16 reciprocates to the rear (arrow 44 in FIG. 7), a lower side surface of the bolt carrier 16 contacts the foldable extension portion 22, causing it to pivot toward the rear on the pivot pin 24 and against the bias of the spring 28 without displacing the locking bar body 26 or affecting its locking of the trigger member 14. In this manner, the locking member 12 can be of sufficient of upward extension length to be engaged by the bolt carrier 14 when it reaches its substantially in-battery position (FIG. 6), while allowing rearward reciprocation of the bolt carrier 16 without causing damage to the locking member 12 or inducing an interference malfunction.

Figure 8:
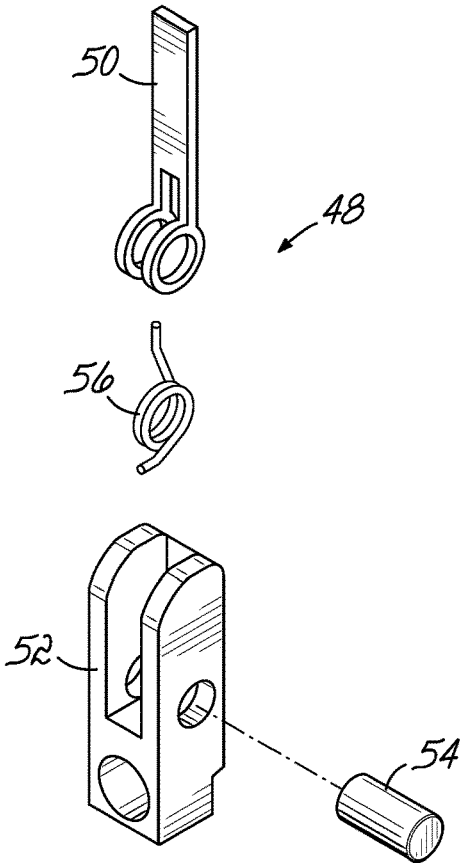
FIG. 8 is an exploded isometric view of an alternative embodiment locking member.
Figure 9:
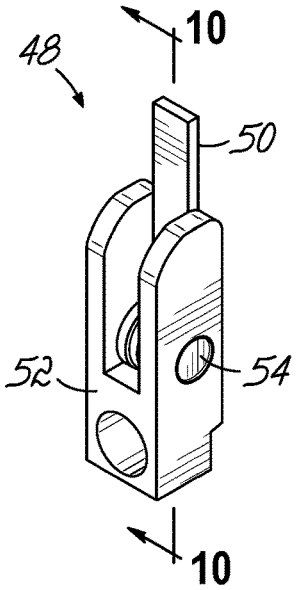
FIG. 9 is an assembled view thereof.
Figure 10:
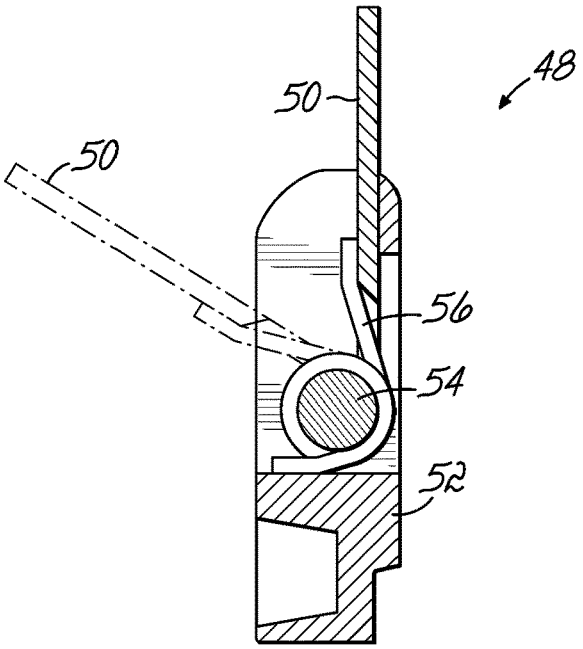
FIG. 10 is a side sectional view taken substantially along line 10-10 of FIG. 9, showing the displaced position of the hinged extension in phantom line.

Referring now to FIGS. 8-10, therein is shown a locking member 48 according to an alternate embodiment of the present invention. According to this embodiment, a foldable extension portion 50 is pivotable in one direction relative to the locking bar body 52 and both parts 50, 52 pivot along a single substantially transverse pivot axis provided by pivot pin 54. Again, the foldable extension portion 50 may be biased toward the extended position by a spring 56 and, as shown in FIG. 10, the hinging movement of the foldable extension portion is operable separate from the locking bar body 52 in a rearward direction but engages an abutment surface 58 for unitary movement when the foldable extension portion 50 is actuated toward a forward direction.

The deflectable extension portion 22, 50 of any embodiment can include a feature to reduce contact friction as the bolt carrier 16 slides rearwardly over it. For example, the contact surface would include a coating or treatment, it would include a friction-reducing material, such as ultra-high-molecular-weight (UHMW) polyurethane, or could include a rolling member, like a wheel.

The present invention can be adapted to other embodiments. For example, it can be adapted to sliding locking member, such as that shown in U.S. Pat. No. 11,346,627, issued May 31, 2022. A sliding locking member (not shown) can include an upward extension that is engaged by the bolt carrier 16 to slide the locking member to the unlocked position, but that also is deflectable to allow passage of the retracting forward portion of the bolt carrier 16.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. In a forced rest trigger mechanism, an extended trigger member locking device, comprising:

a locking member that is movable between a first position in which it locks a trigger member against pulling movement and a second position where it does not restrict movement of the trigger member, the locking member configured to be movably supported by a frame and including a generally upward extension portion configured to make actuating contact with a surface of a bolt carrier, such actuating contact causing the locking member to move from the first position to the second position, the locking member having a body portion that is movably supported and an upwardly extending deflectable portion that is separately movable relative to the body portion between an extended position and a deflected position.

2. The device of claim 1, wherein the locking member is supported by a trigger housing.

3. The device of claim 1, wherein the locking member body portion pivots between the first and second positions.

4. The device of claim 1, wherein the locking member deflectable portion pivots relative to the body portion.

5. The device of claim 3, wherein the locking member deflectable portion pivots relative to the body portion on a pivot axis coaxial with that of the body portion.

6. The device of claim 1, wherein the locking member deflectable portion is spring biased toward the extended position.

* * * * *